US008709163B2

(12) United States Patent
Kim et al.

(10) Patent No.: US 8,709,163 B2
(45) Date of Patent: Apr. 29, 2014

(54) METHOD OF DESCALING A MASK

(75) Inventors: Eui-Gyu Kim, Suwon-si (KR); Tae-Hyung Kim, Suwon-si (KR)

(73) Assignee: Samsung Display Co., Ltd. (KR)

( * ) Notice: Subject to any disclaimer, the term of this patent is extended or adjusted under 35 U.S.C. 154(b) by 1354 days.

(21) Appl. No.: 11/280,542

(22) Filed: Nov. 15, 2005

(65) Prior Publication Data

US 2006/0102194 A1 May 18, 2006

(30) Foreign Application Priority Data

Nov. 18, 2004 (KR) ..... 10-2004-0094419

(51) Int. Cl.

| | |
|---|---|
| ***B08B 7/00*** | (2006.01) |
| ***B08B 7/04*** | (2006.01) |
| ***B08B 3/00*** | (2006.01) |
| ***B08B 3/04*** | (2006.01) |
| ***B08B 3/12*** | (2006.01) |

(52) U.S. Cl.

CPC ..... *B08B 7/0042* (2013.01); *B08B 3/04* (2013.01); *B08B 2209/005* (2013.01); *B08B 3/12* (2013.01); *Y10S 134/902* (2013.01)

USPC ..... 134/1; 134/1.1; 134/26; 134/32; 134/184; 134/902

(58) Field of Classification Search

CPC .. B08B 2209/00; B08B 2209/05; B08B 3/10; B08B 3/12; B08B 5/00; B08B 7/0035; B08B 7/0042; B08B 7/04; B08B 9/00; B08B 11/00; B08B 7/028; B08B 3/04

USPC ..... 134/1, 1.3, 26, 32, 184, 902

See application file for complete search history.

(56) References Cited

U.S. PATENT DOCUMENTS

| | | | | |
|---|---|---|---|---|
| 4,569,695 | A * | 2/1986 | Yamashita et al. | 134/1 |
| 5,654,057 | A * | 8/1997 | Kitayama et al. | 428/64.1 |
| 5,669,979 | A * | 9/1997 | Elliott et al. | 134/1 |
| 6,178,973 | B1 * | 1/2001 | Franca et al. | 134/1.3 |
| 6,199,298 | B1 * | 3/2001 | Bergman | 34/315 |
| 6,217,665 | B1 * | 4/2001 | Suzuki | 134/1 |
| 6,544,893 | B2 * | 4/2003 | Eto | 438/693 |
| 6,709,532 | B2 * | 3/2004 | Chang et al. | 134/26 |
| 6,841,008 | B1 * | 1/2005 | Branco et al. | 134/26 |
| 6,938,626 | B2 * | 9/2005 | Inagaki | 134/56 R |
| 2002/0059943 | A1 * | 5/2002 | Inagaki | 134/18 |
| 2002/0124875 | A1 * | 9/2002 | Chang et al. | 134/30 |

(Continued)

FOREIGN PATENT DOCUMENTS

| | | |
|---|---|---|
| CN | 1282277 A | 1/2001 |
| JP | 01-226157 | 9/1989 |

(Continued)

OTHER PUBLICATIONS

Translation of KR 10-0487834.*

(Continued)

*Primary Examiner* — Alexander Markoff

(74) *Attorney, Agent, or Firm* — Knobbe, Martens, Olson & Bear LLP

(57) ABSTRACT

Provided is a method of descaling a mask that quickly and effectively removes a material attached to the mask. The method includes: directing a laser beam onto a material attached to the mask; and removing the material attached to the mask.

12 Claims, 4 Drawing Sheets

(56) References Cited

U.S. PATENT DOCUMENTS

| | | | | |
|---|---|---|---|---|
| 2003/0124764 | A1* | 7/2003 | Yamazaki et al. | 438/99 |
| 2005/0000545 | A1* | 1/2005 | Inagaki | 134/18 |
| 2005/0115594 | A1* | 6/2005 | Hosoda et al. | 134/61 |
| 2005/0124524 | A1* | 6/2005 | Ishikawa et al. | 510/407 |
| 2005/0252523 | A1* | 11/2005 | Ishikawa et al. | 134/1 |
| 2006/0042667 | A1* | 3/2006 | Kinomura et al. | 134/105 |
| 2006/0042669 | A1* | 3/2006 | Kinomura et al. | 134/135 |

FOREIGN PATENT DOCUMENTS

| | | |
|---|---|---|
| JP | 05-166784 | 7/1993 |
| JP | 2002-082211 | 3/2002 |
| JP | 2002-241925 | 8/2002 |
| JP | 2003-171694 | 6/2003 |
| JP | 2004-097881 | 4/2004 |
| JP | 2004-300495 | 10/2004 |
| KR | 100487834 | 4/2005 |
| WO | WO 99/30845 | 6/1999 |

OTHER PUBLICATIONS

Office Action issued by the Chinese Patent Office on May 8, 2009 with English translation in 10 pgs.

Chinese Registration of Determination Certificate corresponding to U.S. Appl. No. 11/280,542 dated Feb. 16, 2011, 10 pages.

* cited by examiner

METHOD OF DESCALING A MASK

CROSS-REFERENCE TO RELATED APPLICATIONS

This application claims the benefit of Korean Patent Application No. 10-2004-0094419, filed on Nov. 18, 2004, in the Korean Intellectual Property Office, the disclosure of which is incorporated herein in its entirety by reference.

BACKGROUND OF THE INVENTION

1. Field of the Invention

The present embodiments relate to a method of descaling a mask, and more particularly, to a method of descaling a mask that quickly and effectively removes material attached to the mask.

2. Description of the Related Art

Electroluminescence display devices as emissive type display devices are expected to be next generation display devices due to their wide viewing angles, high contrast, and high response speed.

Electroluminescence display devices are classified as organic light emitting display devices and inorganic light emitting display devices according to material that forms the emission layer (EML) included therein. In particular, organic light emitting display devices are brighter, and have higher driving voltage and higher response speed than inorganic light emitting display devices and can display color images.

An organic light emitting diode (OLED), which is an organic light emitting display device, includes an interlayer located between electrodes facing each other. The interlayer can consist of a variety of layers, e.g., a Hole Injection Layer (HIL), a Hole Transport Layer (HTL), an EML, an Electron Transport Layer (ETL), an Electron Injection Layer (EIL), and the like. Such layers of the organic light emitting device are organic thin films.

Organic thin films such as the HIL, HTL, EML, ETL, EIL, and the like can be formed on a substrate using a deposition method in a deposition apparatus when fabricating the OLED.

Using the deposition method, a thin film is fabricated on a substrate in a vacuum chamber by heating a heating a crucible containing a material to be deposited, and evaporating or sublimating the material to be deposited.

The organic material forming the thin film of the OLED is evaporated or sublimated within a temperature range of from about 250° C. to about 450° C. and a degree of vacuum of from about $10^{-6}$ to about $10^{-7}$ torr.

Electroluminescence display devices include electrodes facing each other. In particular, an active drive type electroluminescence display device includes thin film transistors having electrodes made of metal, so that such electrodes can be formed using a deposition method.

An electrode material usually evaporates at a temperature higher than the evaporating temperature of the organic material. Such an evaporation temperature varies according to the type of electrode material. Commonly used materials such as magnesium (Mg) and silver (Ag) evaporate at temperatures higher than from about 500° C. to about 600° C., and about 1000° C., respectively. Aluminum (Al) used as the electrode material and lithium (Li) evaporates at temperatures of about 1000° C. and about 300° C., respectively.

A mask is used to form an organic film or a metal film using the deposition method so that the organic film or the metal film can have a specific pattern. To be more specific, a mask having a slit with a predetermined pattern is formed and the organic film or the metal film is deposited through the slit in a desired pattern.

The mask is removed after completing the deposition, in which the organic film or the metal film is necessarily attached to the mask. Such material attached to the mask needs to be removed in order to recycle the removed mask.

Conventionally, an organic solvent is used to remove the material attached to the mask after the deposition. That is, the material attached to the mask is removed by immersing the mask in an organic solvent such as acetone. However, the mask must be immersed in the organic solvent for at least 48 hours in order to remove the material attached to the mask. Therefore, a lot of masks are required for mass production in turn, causing an increase in production costs.

SUMMARY OF THE INVENTION

The present embodiments provide a method of descaling a mask that quickly and effectively removes material attached to the mask.

According to an aspect of the present embodiments, there is provided a method of descaling a mask, the method comprising: directing a laser beam onto a material attached to the mask; and removing the material attached to the mask.

The removing of the material attached to the mask may comprise: immersing the mask in deionized water; and immersing the mask in an organic solvent.

The immersing of the mask in the deionized water may comprise: directing an ultrasonic wave into the deionized water while the mask is immersed in the deionized water.

The directing of the ultrasonic wave into the deionized water while the mask is immersed in the deionized water may be performed to form a focus on the surface of the deionized water.

The immersing of the mask in the deionized water may comprise: directing the ultrasonic wave into the deionized water at least twice while the mask is immersed in the deionized water.

The immersing of the mask in the organic solvent may be performed to remove the material attached to the mask.

The removing of the material attached to the mask may comprise: immersing the mask in the organic solvent for at least one minute.

The method may further comprise: drying the mask.

BRIEF DESCRIPTION OF THE DRAWINGS

The above and other features and advantages of the present embodiments will become more apparent by describing in detail exemplary embodiments thereof with reference to the attached drawings in which.

DETAILED DESCRIPTION OF THE INVENTION

The present embodiments will now be described more fully with reference to the accompanying drawings in which exemplary embodiments are shown.

Figure 1:
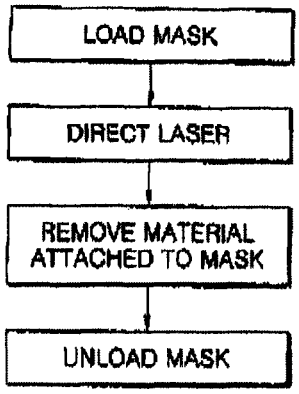
FIG. 1 is a flowchart schematically illustrating a method of descaling a mask according to an embodiment.

FIG. 1 is a flowchart schematically illustrating a method of descaling a mask according to one embodiment.

Referring to FIG. 1, the method comprises directing a laser beam onto a material attached to the mask and removing the material attached to the mask.

Conventionally, an organic solvent is used to remove the material attached to the mask after deposition. That is, the material attached to the mask is removed by immersing the mask in an organic solvent such as acetone. However, the mask must be immersed in the organic solvent for at least 48 hours in order to remove the material attached to the mask, which causes problems with mass production because of time constraints.

To solve such a problem, the method of descaling the mask according to the current embodiment can be used. In this embodiment, the laser beam is directed onto the material attached to the mask. The type of laser used can be, for example, an Nd: Yag Laser. Exemplary laser specifications include a pulse frequency of about 60 Hz and a pulse strength of about 600 mJ to about 900 mJ. In some embodiments, the laser pulses are directed such that there is an overlap of about half of a pulse width for consecutive laser pulses. When the laser is directed onto the material attached to the mask, plasma generated by the laser beam expands, thereby producing a shock wave, which spreads in many directions. Such a shock wave weakens both the material attached to the mask and bonds between the material and the mask. As a result, the material attached to the mask can be more quickly removed using the organic solvent, thereby reducing time required to remove the material.

When the mask is immersed in the organic solvent without any processing of the material attached to the mask, it often takes about 48 hours or more for the material to be removed from the mask. However, when the mask is immersed in the organic solvent after the laser beam is directed onto the material attached to the mask and the material is weakened using the method of descaling the mask according to the present embodiment, the material is removed after only about 5 minutes. The organic solvent may be, for example, acetone or normal methyl pyrrolidinone, which is equally applied to the following embodiments.

When the material attached to the mask is removed by directing the laser beam onto the material and weakening the material, a conventional apparatus can be used as it is. Thus, there is no requirement of additional facility investment.

In another embodiment, the material attached to the mask can be removed by directing the laser beam onto the material without the organic solvent. In this case, however, heat generated by the directed laser beam may sometimes deform the mask, causing the slit in the mask to be deformed. Such a deformation of the slit makes it difficult to recycle the mask. Therefore, it is better to remove the material attached to the mask by immersing the mask in the organic solvent after directing the laser beam onto the mask such that the mask is not deformed and only the attached material is weakened.

Thereafter, the method of descaling the mask may further include drying the substrate using an air knife.

The material attached to the mask is removed by directing the laser beam onto the attached material and weakening the material and bonds between the material and the mask, e.g., using the existing process, so that an increase in manufacturing expenses can be minimized and time required to remove the material can be dramatically reduced from more than about 48 hours or more to about 5 minutes.

Figure 2:
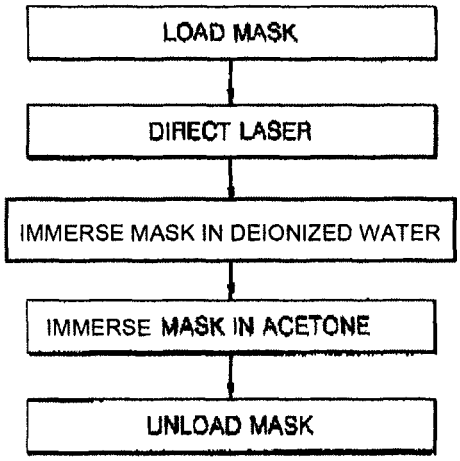
FIG. 2 is a flowchart schematically illustrating a method of descaling a mask according to another embodiment.
Figure 3:
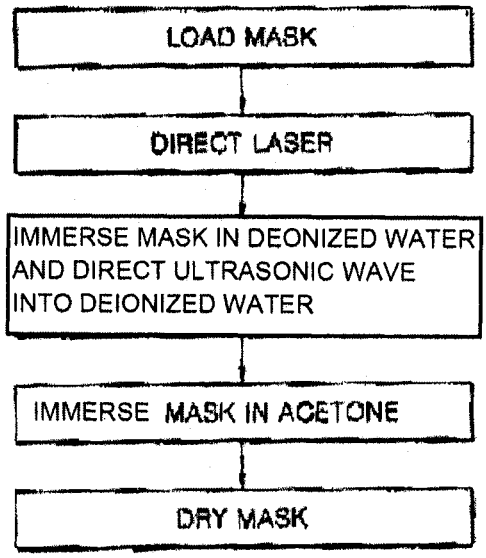
FIG. 3 is a flowchart schematically illustrating a method of descaling a mask according to still another embodiment.

FIG. 2 is a flowchart schematically illustrating a method of descaling a mask according to another embodiment, and FIG. 3 is a flowchart schematically illustrating a method of descaling a mask according to still another embodiment.

Referring to FIGS. 2 and 3, the method of descaling the mask comprises directing a laser beam onto a material attached to the mask, immersing the mask in deionized water, and immersing the mask in an organic solvent. The immersing of the mask in deionized water may comprise directing an ultrasonic wave into the deionized water while the mask is immersed in the deionized water.

The method of descaling the mask according to the present embodiment also comprises directing the laser beam onto the material attached to the mask. In this case, plasma generated by the laser beam expands, thereby producing a shock wave, which spreads in many directions. Such a shock wave weakens the material attached to the mask. Thereafter, the mask can be immersed in the deionized water, and the ultrasonic wave can be directed onto the deionized water if necessary while the mask is immersed in the deionized water. The ultrasonic wave may be adjusted to form a focus on the surface of the deionized water.

When the ultrasonic wave is adjusted to form the focus on the surface of the deionized water, the shock wave is generated inside the deionized water by the directed ultrasonic wave, and the generated shock wave is applied to the material attached to the mask, which weakens the material and the bonds between the material and the mask. Therefore, the material can be more effectively removed using an organic solvent.

The direction of the ultrasonic wave into the deionized water while the mask is immersed in the deionized water can be performed once, twice, three times, four times, five times, six times, seven times, eight times, nine times, ten times or more, or not at all.

The material attached to the mask is removed by directing the laser beam onto the material, thereby weakening the material, immersing the mask in deionized water, and directing the ultrasonic wave into the deionized water to form a focus on the surface of the deionized water, thereby minimizing manufacturing expenses and dramatically reducing time required to remove the material from about 48 hours or more to about 5 minutes.

Figure 4:
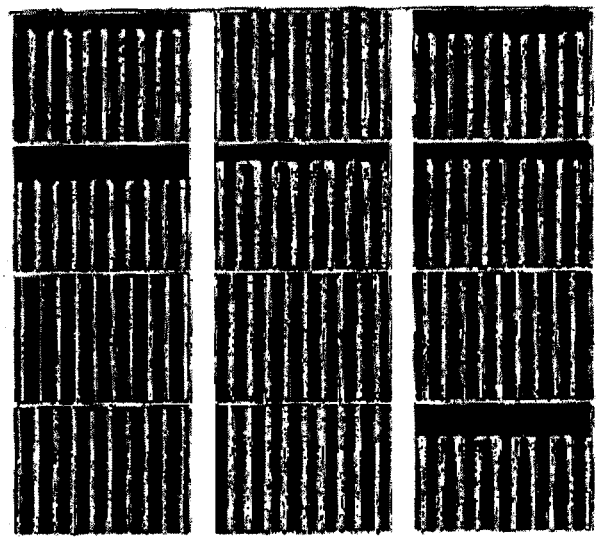
FIG. 4 is a series of photographs of a descaled mask according to the method of descaling a mask illustrated in FIGS. 1, 2, and 3.

FIG. 4 is a series of photographs of a descaled mask according to the methods of descaling a mask illustrated in FIGS. 1, 2, and 3. For the descaled mask, fifty-four mask cells are manufactured to confirm a reduction in descaling time of the mask using a laser beam.

FIG. 4 shows that material attached to the mask is clearly removed while maintaining the shape of the slit in the mask.

Figure 5:
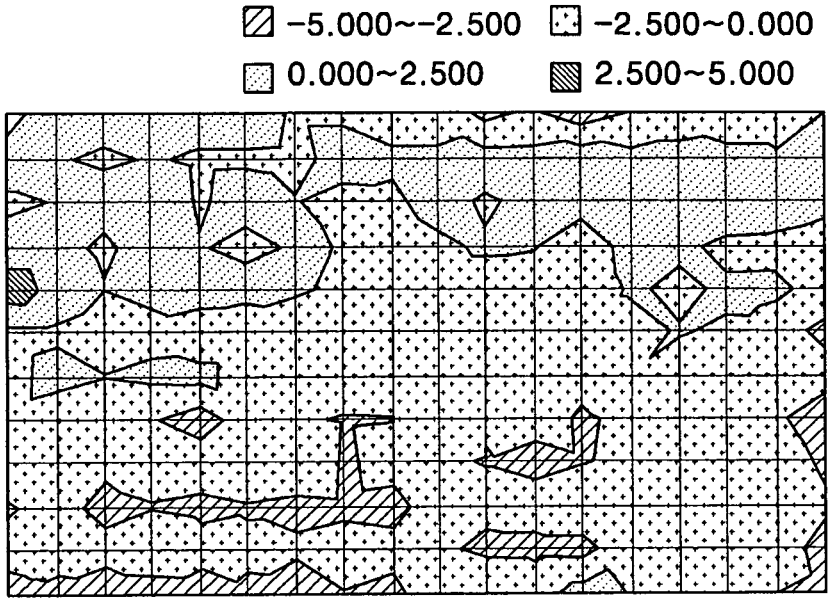
FIG. 5 is a graph illustrating total pitch data of an unsealed mask according to the method of descaling a mask illustrated in FIGS. 1, 2, and 3.
Figure 6:
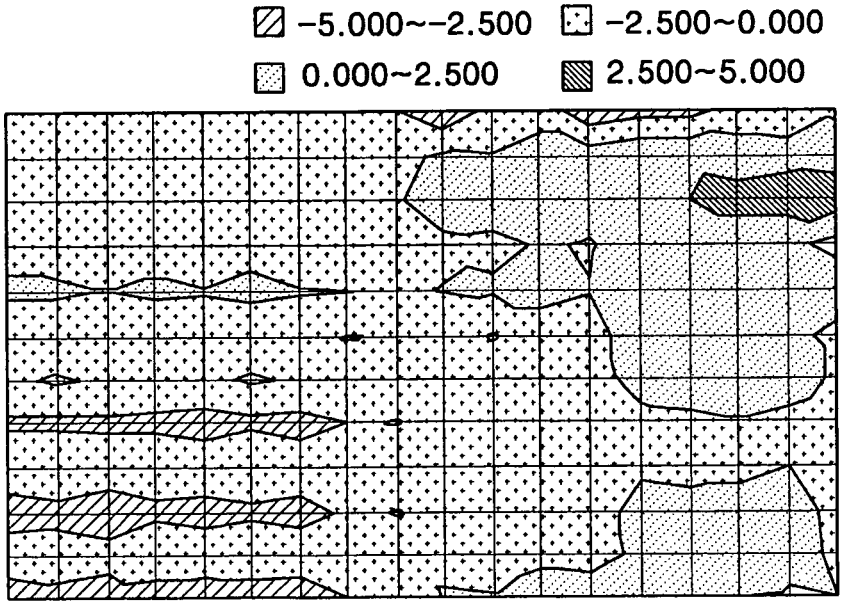
FIGS. 6 and 7 are graphs illustrating total pitch data of a descaled mask according to the method of descaling a mask illustrated in FIGS. 1, 2, and 3.
Figure 7:
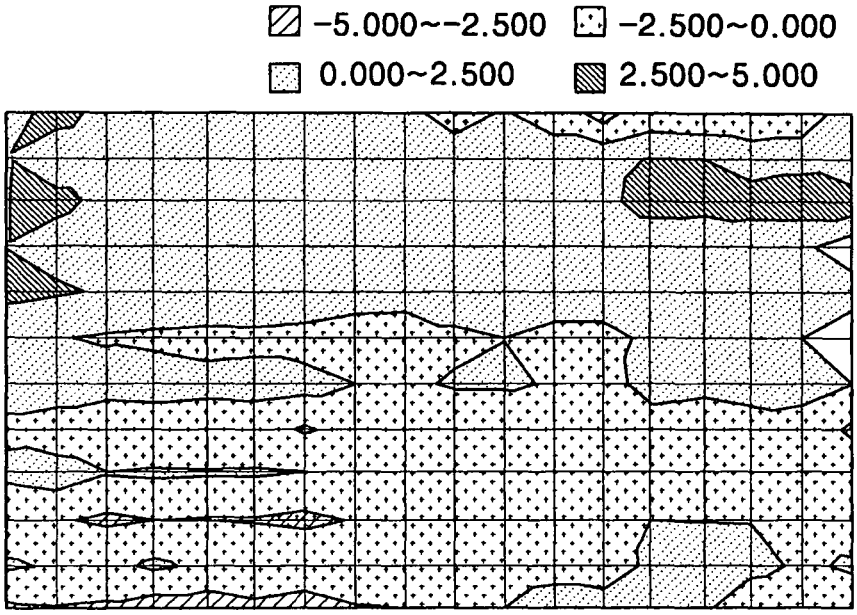

FIG. 5 is a graph illustrating total pitch data of an unsealed mask according to the method of descaling the mask illustrated in FIGS. 1, 2, and 3. FIGS. 6 and 7 are graphs illustrating total pitch data of a descaled mask according to the method of descaling the mask illustrated in FIGS. 1, 2, and 3.

The material attached to the mask can be removed by directing the laser beam onto the material. However, when this is done, heat generated by the directed laser beam deforms the mask, which causes the slit in the mask to be deformed. Such a deformation of the slit makes it difficult to recycle the mask. Therefore, the material attached to the mask is more easily removed by immersing the mask in the organic solvent after directing the laser beam onto the mask such that the mask is not deformed and only the attached material is weakened.

Referring to FIG. 5, which is a graph illustrating total pitch data indicating a degree of deformation of the unsealed mask according to the method of descaling the mask illustrated in FIGS. 1, 2, and 3, the error rate of the total pitch is 3.98. FIGS. 6 and 7 are graphs illustrating total pitch data, measured twice, of the descaled mask according to the method of descaling the mask illustrated in FIGS. 1, 2, and 3.

With regard to descaling conditions of the mask, the laser beam is directed onto the material attached to the mask, the mask is immersed in the deionized water for 5 minutes, the ultrasonic wave of 100 kHz is directed onto the deionized water for 1 minute, and the mask is immersed in acetone for 1 minute to remove the material.

Error rates of the total pitch, measured twice, of the descaled mask according to the descaling conditions were 4.12 μm and 3.84 μm, respectively. Therefore, there is little difference between the error rates of the total pitches of the unsealed mask and the descaled mask, thereby dramatically reducing time to descale the mask from about 48 hours to about 5 minutes according to the method of descaling the mask of the present embodiments.

The method of descaling the mask of the present embodiments has the following effects:

First, the material attached to the mask is removed by weakening the material using the laser beam and immersing the mask in an organic solvent, thereby dramatically reducing time to remove the material from about 48 hours to about 5 minutes.

Second, the material attached to the mask is removed by directing the laser beam onto the material, weakening the material, immersing the mask in the deionized water, and directing an ultrasonic wave on the deionized water to form a focus on the surface of the deionized water, thereby minimizing manufacturing expenses and dramatically reducing time required to remove the material from about 48 hours or more to about 5 minutes.

While the present embodiments have been particularly shown and described with reference to exemplary embodiments thereof, it will be understood by those of ordinary skill in the art that various changes in form and details may be made therein without departing from the spirit and scope of the present embodiments as defined by the following claims.

What is claimed is:

1. A method of descaling a deposition mask, the method comprising:

providing a deposition mask, the deposition mask comprising:

a pattern comprising an opening, wherein the opening is configured to pass a material there though to be deposited onto a substrate; and a thin film of the material attached to the deposition mask;

directing a laser beam with a pulse frequency of about 60 Hz and a pulse strength of about 600 mJ to about 900 mJ onto the material attached to the deposition mask to weaken the bonds between the material and the mask;

removing the material attached to the mask, comprising:

immersing the deposition mask in deionized water, wherein immersing comprises directing an ultrasonic wave into the deionized water while the deposition mask is immersed in the deionized water;

immersing the deposition mask in a liquid organic solvent; and drying the deposition mask using an air knife.

2. The method of claim 1, wherein the directing of the ultrasonic wave into the deionized water while the deposition mask is immersed in the deionized water forms a focus on the surface of the deionized water.

3. The method of claim 1, wherein the immersing of the deposition mask in the deionized water comprises directing an ultrasonic wave into the deionized water at least twice while the deposition mask is immersed in the deionized water.

4. The method of claim 1, wherein the removing of the material attached to the deposition mask comprises immersing the deposition mask in the organic solvent for at least about one minute.

5. The method of claim 1, wherein the pattern comprises a slit.

6. The method of claim 1, wherein the thin film of the material comprises an organic material.

7. The method of claim 1, wherein the thin film of the material comprises a metal material.

8. The method of claim 1, wherein directing the laser beam comprises directing a laser beam produced by an Nd:YAG laser.

9. The method of claim 1, wherein directing the laser beam comprises applying a plurality of consecutive laser pulses wherein about half of pulse widths of two consecutive laser pulses overlap each other.

10. The method of claim 1, further comprising generating a plasma using the directed laser beam.

11. The method of claim 1, wherein immersing the deposition mask in the liquid organic solvent comprises immersing the deposition mask in a liquid organic solvent comprising one of acetone and pyrrolidinone.

12. The method of claim 1, wherein immersing the deposition mask in the liquid organic solvent comprises immersing the deposition mask in the liquid organic solvent for a time duration not exceeding about 5 minutes.

* * * * *